United States Patent [19]

Arp

[11] 4,091,725

[45] May 30, 1978

[54] CONTAINER CRUSHING DEVICE

[76] Inventor: Ewald A. Arp, 15910 Cedar Ridge Rd., Hopkins, Minn. 55343

[21] Appl. No.: 766,946

[22] Filed: Feb. 9, 1977

Related U.S. Application Data

[63] Continuation of Ser. No. 612,088, Sep. 10, 1975, abandoned.

[51] Int. Cl.[2] ..... B30B 15/30

[52] U.S. Cl. ..... 100/45; 100/53; 100/91; 100/99; 100/215; 100/218; 100/264; 100/282; 100/295; 100/DIG. 2; 209/38

[58] Field of Search ..... 100/45, 282, 264, 247, 100/DIG. 2, 215, 218, 99, 91, 53, 295; 209/38; 241/99

[56] References Cited

U.S. PATENT DOCUMENTS

| | | | |
|---|---|---|---|
| 2,800,159 | 7/1957 | Walsh | 100/DIG. 2 |
| 2,982,200 | 5/1961 | Robertson | 100/DIG. 2 |
| 3,232,220 | 2/1966 | Sileski | 100/DIG. 2 |
| 3,374,730 | 3/1968 | Cain | 100/DIG. 2 |
| 3,412,837 | 11/1968 | Myers | 100/DIG. 2 |
| 3,687,062 | 8/1972 | Frank | 100/91 |
| 3,792,765 | 2/1974 | Arp | 100/DIG. 2 |
| 3,907,087 | 9/1975 | Tanaka | 100/DIG. 2 |

*Primary Examiner*—Billy J. Wilhite
*Attorney, Agent, or Firm*—Merchant, Gould, Smith, Edell, Welter & Schmidt

[57] ABSTRACT

Apparatus for crushing containers, such as beverage cans, in a crushing zone between a movable ram and a relatively stationary platen, and for delivering the crushed containers to given receptacles according to the material of the containers. Control means for power operated means, such as a container counting device, includes a pair of movable container engaging probe members that are adapted to engage opposite ends of a container in a testing zone through which the container passes during movement to the crushing zone, the probe members comprising portions of an electric circuit also including a selector switch having a movable switch element. The extent of movement of the movable switch element is governed by the extent of movement of the probe members toward and away from engagement with a container. Power operated mechanism imparts movements to the ram, probe members, and a container feeding device. The feeding device is disposed to feed containers in succession toward the crushing apparatus, and is limited in its feeding ability to containers weighing less than a given maximum weight.

16 Claims, 27 Drawing Figures

82
25
89
81
79
77
76
76
28
83
34
38
116
115
74
138
134
107
100
143
141
144
136
150
151
104
106
101
159
44
55
101
45
43
152
182
125
189
100
179
67
64
65
66
30
39
37
56
63
61
60
62
42
59
27
29
33

FIG. 24
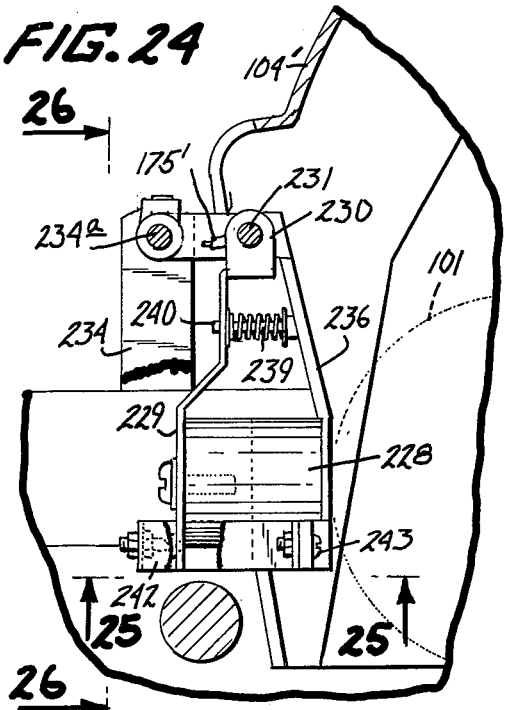
FIG. 27
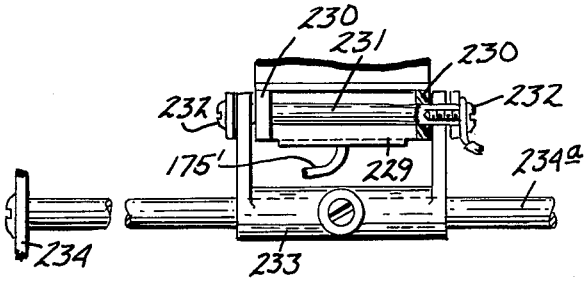
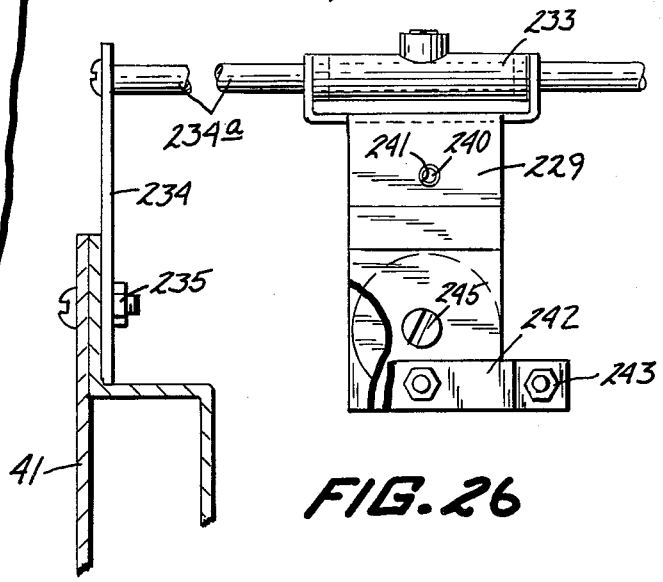
FIG. 26
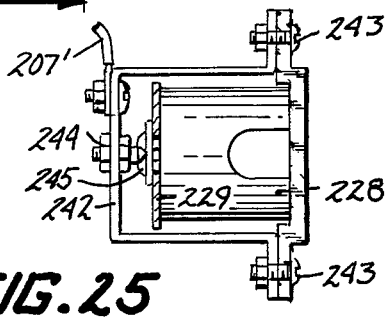
FIG. 25
FIG. 23
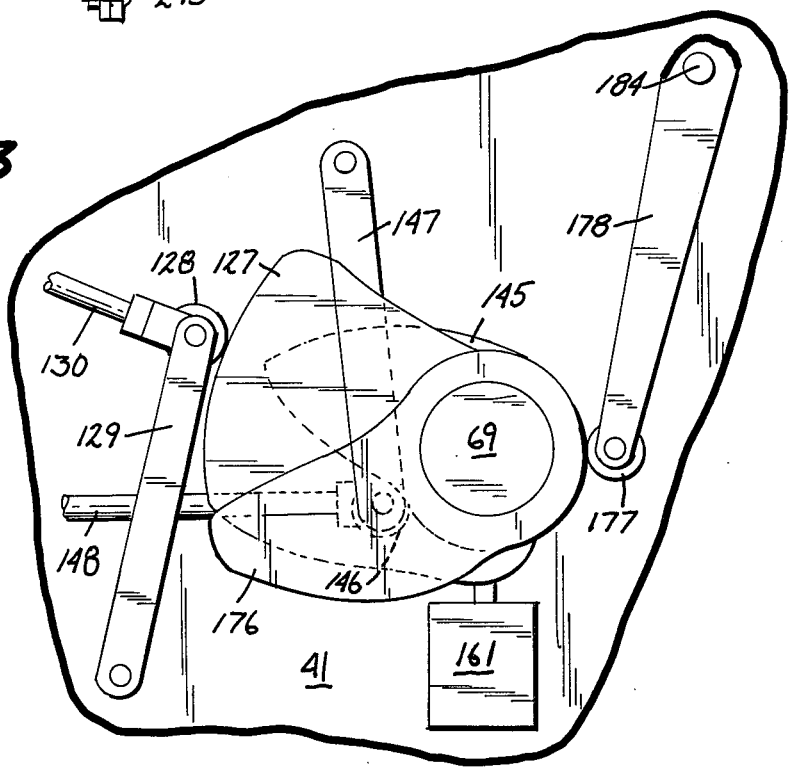

CONTAINER CRUSHING DEVICE

This is a continuation of application Ser. No. 612,088, filed Sept. 10, 1975, now abandoned.

BACKGROUND OF THE INVENTION

This invention relates to devices for crushing or flattening and storing empty containers, such as beverage cans made from metal or other crushable material, and is in the nature of an improvement on the apparatus disclosed in my prior U.S. Pat. Nos. 3,792,765 and 3,857,334. In the crushing or flattening of containers for shipment to the place of recycling the material thereof, it is desirable that the crushed containers be sorted as to materials, and that such sorting be done automatically during the operation of the apparatus, to minimize handling or sorting operations in connection with the salvage of material. It is also important that containers filled with liquid or other material, or other foreign objects, be excluded from the crushing apparatus, to avoid damage to the apparatus. Also, for the purpose of keeping a proper record of containers passing through the apparatus and crushed therein, it is desirable that each container be counted regardless of its size, within the size capabilities of the machine.

SUMMARY OF THE INVENTION

The container crushing apparatus of this invention involves a frame structure and crushing means carried by the frame structure, including a relatively stationary platen and a relatively movable ram cooperating with the platen to define a crushing zone therebetween. Means is provided for feeding containers singly and in succession to the crushing zone, as is power operated mechanism for imparting container crushing reciprocatory movements to the ram toward and away from the platen. A pair of spaced receptacles is provided for receiving crushed containers, and container delivery means underlies the crushing zone for receiving crushed containers from the crushing zone and delivering each crushed container to its predetermined one of the receptacles, the container delivery means including a magnet. The apparatus further includes power operated means and control means therefore, the control means including container engaging means and operative to energize the power operated means responsive to feeding of given ones of the containers toward the crushing zone.

DESCRIPTION OF THE DRAWING

FIG. 23 is an enlarged fragmentary view in side elevation, corresponding to a portion of FIG. 2;

FIG. 24 is a view corresponding to a portion of FIG. 5, but showing a modified form of magnetically operated switch;

FIG. 25 is a fragmentary view in bottom plan as seen from the line 25—25 of FIG. 24;

FIG. 26 is a fragmentary view partly in elevation and partly in cross section, taken generally on the line 26—26 of FIG. 24; and FIG. 27 is a view in top plan of FIG. 26.

DETAILED DESCRIPTION OF THE PREFERRED EMBODIMENT

Figure 1:
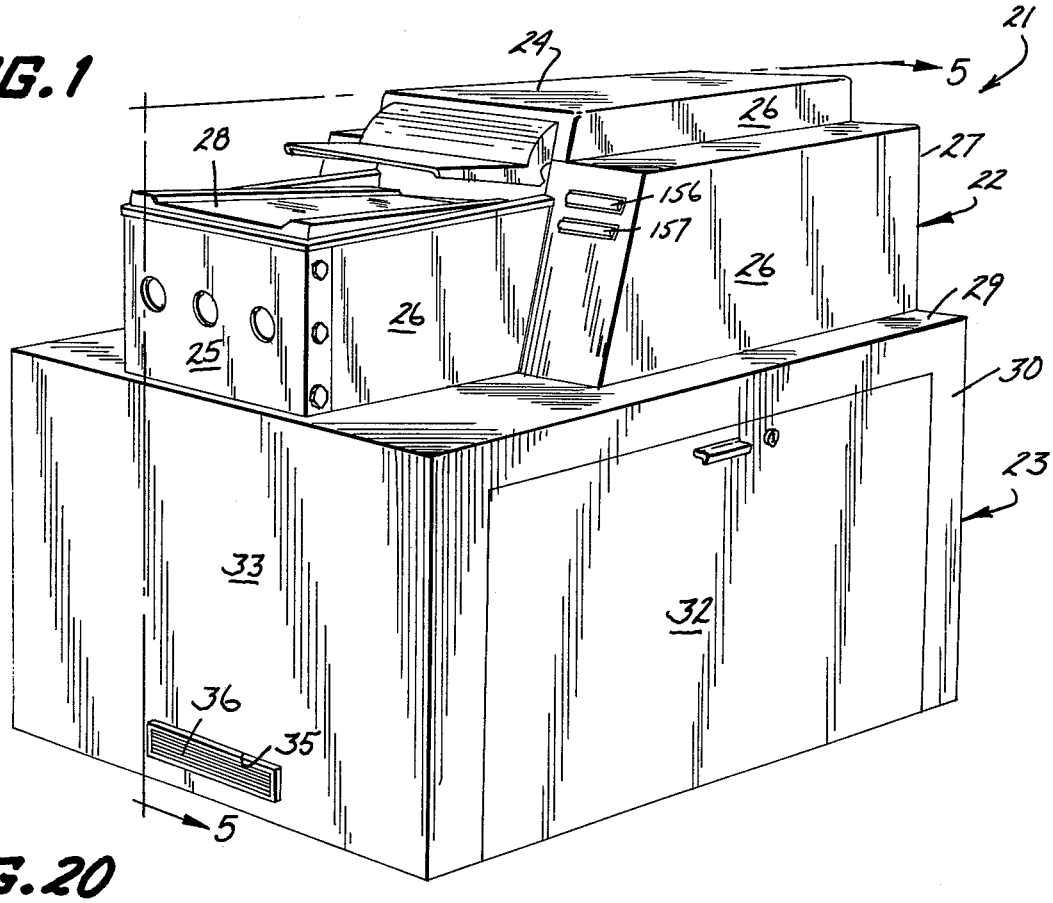
FIG. 1 is a view in perspective of container crushing apparatus produced in accordance with this invention, as seen from the front end and one side.

A housing, indicated in its entirety by the numeral 21 in FIG. 1, forms a portion of a supporting frame structure, the housing 21 comprising upper and lower housing sections 22 and 23 respectively. The upper housing section 22 includes a top wall 24, a front or forwardly facing wall portion 25, opposite side wall portions 26, those on one side only being shown, and a rear wall 27. The forward end portion of the upper housing section 22 defines a downwardly and rearwardly sloping ramp 28 for delivery of containers to the interior of the housing 21. The lower housing section 23 comprises a horizontal top wall 29, opposite side walls 30 and 31, the former of which is provided with a door 32, and front and rear walls 33 and 34 respectively, the front wall being provided with an opening 35 in which is contained a conventional foot operated electric switch 36, shown only in the diagram of FIG. 20. The lower housing section 23 further includes a bottom wall 37 on which is supported a pair of generally rectangular receptacles 38 and 39 for reception of crushed or flattened containers.

The frame structure includes a pair of laterally spaced longitudinal side frame members 40 and 41 that are vertically disposed and have their opposite ends secured to the front and rear wall portions 25 and 27 respectively, the frame members 40 and 41 being preferably fabricated from heavy sheet metal and defining a pair of opposed longitudinal channels 42 for supporting a ram 43 and a cooperating platen 44. The ram 43 includes a container engaging front wall 45, a generally horizontal top wall 46, opposite end walls 47, and rib elements 48 between the end walls 47, see particularly FIG. 10. A pair of supporting bars 49 are secured to the opposite end walls 47 by dowels 50 and screws 51, the bars 49 being supported within respective of ones of the channels 42 by pairs of cross sectional U-shaped bearing shoes 52. Spacers 53 and elongated slide plates 54 are interposed between the ram end walls 47 and the support bars 49 to fully cover the channels 42 between the ram 43 and platen 44. The ram 43 and platen 44 cooperate to define therebetween a container crushing zone 55.

Longitudinal reciprocatory movement is imparted to the ram 43 toward and away from the platen 44 by power operated mechanism including an electric motor 56 having a drive shaft 57, a pulley 58 on the drive shaft 57, an endless flexible drive belt 59 entrained over the pulley 58 and an idler pulley 60 keyed or otherwise rigidly secured on a jack shaft 61 journaled in bearings 62 a sprocket wheel 63 fast on the shaft 61, an endless link chain 64 entrained over the sprocket wheel 63 and over a second sprocket wheel 65 that is mounted on a crank assembly 66, a pair of pitman arms 67, and a wrist pin 68. The crank assembly 66 comprises a crank shaft in the nature of a pair of axially aligned crank shaft sections 69, journaled in bearing assemblies 70 that are mounted in the side frame members 40 and 41, a pair of crank members 71 each keyed to a different one of the crank shaft sections 69, and a crank pin 72 rigidly secured at its opposite ends to the crank members 71, see particularly FIG. 10. The pitman arms 67 are journaled at one end to axially spaced portions of the crank pin 72 by suitable bearings 73, and at their other ends are journaled on the wrist pin 68, the pitman arms 67 being disposed in laterally spaced parallel relationship. The sprocket wheel 65 is welded or otherwise rigidly secured to the crank pin 72, and is eccentric thereto, the sprocket wheel 65 being coaxial with the crank shaft sections 69.

Figure 12:
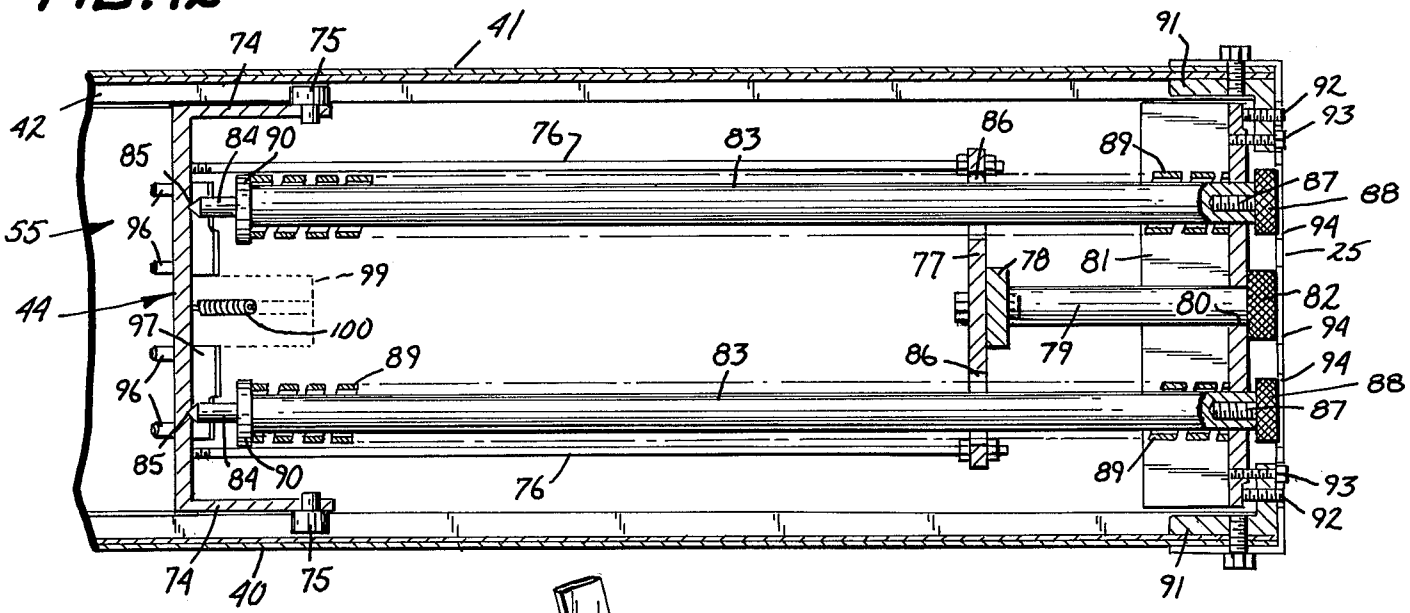
FIG. 12 is an enlarged view in horizontal section taken on the line 12—12 of FIG. 4.

The platen 44 is formed at its opposite ends to provide a pair of end flanges 74 each of which is disposed adjacent and parallel to a respective one of the frame members 40 and 41. Each of the end flanges 74 is provided with a laterally upwardly projecting stud or boss 75, each slidably contained in a different one of the channels 42. Means for mounting the platen 44 in opposed relation to the ram 43 includes the studs or bosses 75, and a plurality of elongated tie rods 76 screw threaded at one end into the platen 44 and secured at their opposite ends to a cross member 77 that is bolted or otherwise rigidly secured at its intermediate portion to a base plate 78. A shaft 79 is secured at one end to the base plate 78 and extends longitudinally forwardly therefrom through a central opening 80 in a cross channel 81 that is disposed in inwardly spaced parallel relation to the end wall 25. Outwardly of the channel 81, the shaft 79 is formed to provide a diametrically enlarged head 82. A pair of laterally spaced parallel thrust shafts 83 have inner or rear end portions 84 that have pointed ends seated in recesses 85 in the platen 44. Intermediate their ends, the thrust shafts 83 extend through enlarged clearance openings 86 in the cross member 77, the outer or front ends of the shafts 83 extending through openings in the cross channel 81, see FIGS. 5 and 12. Stop screws 87 are screw threaded axially into the outer ends of the thrust shafts 83 and have diametrically enlarged heads 88 that engage the cross channel 81 to limit inward movement of the shafts 83 with respect to the cross channel 81. Each of the thrust shafts 83 is surrounded by one of a pair of coiled compression springs 89, each spring 89 engaging the cross channel 81 at one end of a flange 90 adjacent the inner end portion 84 of each thrust shaft 83, to yieldingly hold the platen 44 against normal crushing or flattening effort of a container being crushed thereagainst by the ram 43 in the crushing zone 55. The opposite ends of the cross channel 81 are secured to a pair of reinforcing angle bars 91 bolted or otherwise rigidly secured to the side frame members 40 and 41 adjacent the front wall 25. A pair of adjustment screws 92 are screw threaded in the angle bars 91 and abut end portions of the cross channel 81, to vary the spacing between the platen 44 and the ram 43. A pair of locking screws 93 extend through suitable openings in the angle bars 91 and are screw threaded into the cross channel 81 to securely hold the same against the inner ends of the adjustment screws 92. In the event that an uncrushable object is disposed in the crushing zone 55 and the ram is moved into crushing engagement therewith towards the platen, the springs 89 will yield to permit forward movement of the platen. The front wall portion 25 is provided with openings 94 to permit movement of the heads 82 and 88 therethrough in the event that the platen 44 is moved forwardly against bias of the compression springs 89.

Figure 4:
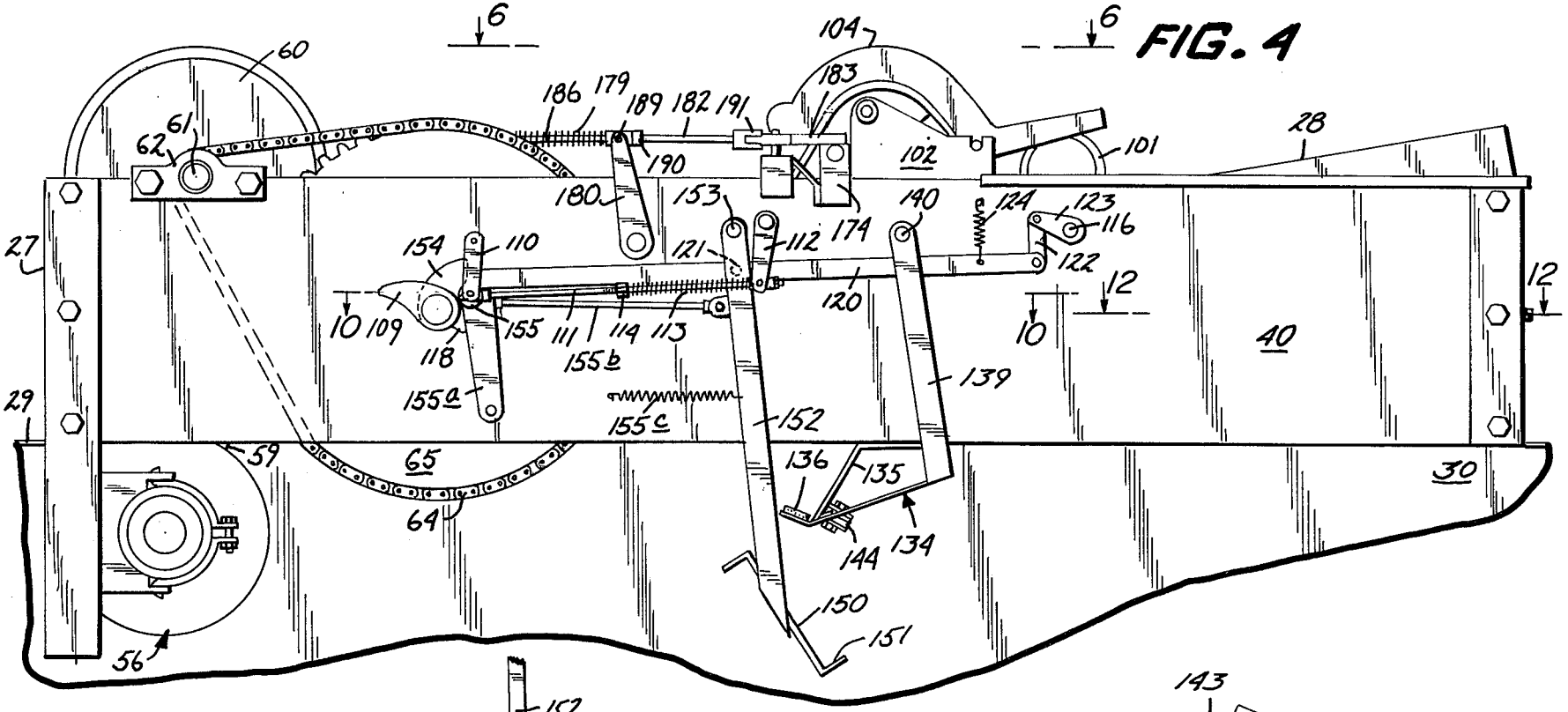
FIG. 4 is a fragmentary view in side elevation, as seen from the side opposite that of FIG. 2, some parts being removed.
Figure 17:
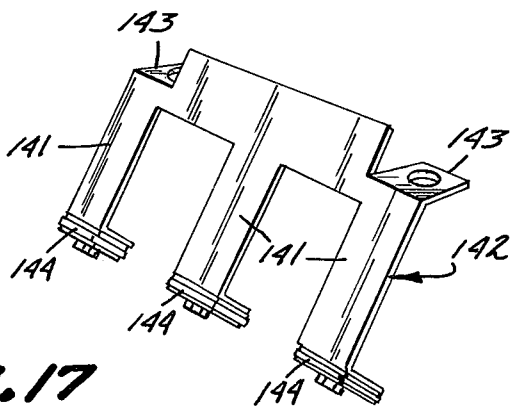
FIG. 17 is a view in perspective of a magnet equipped portion of the container delivering means of this invention.
Figure 18:
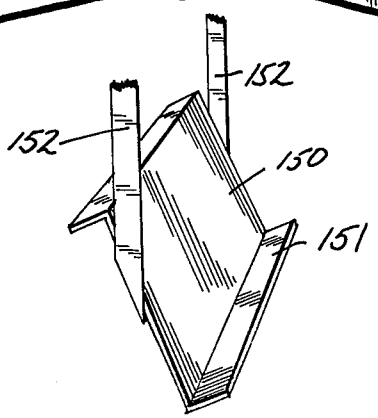
FIGS. 18 and 19 are fragmentary views in perspective of other portions of the crushed container delivering means of this invention.
Figure 5:
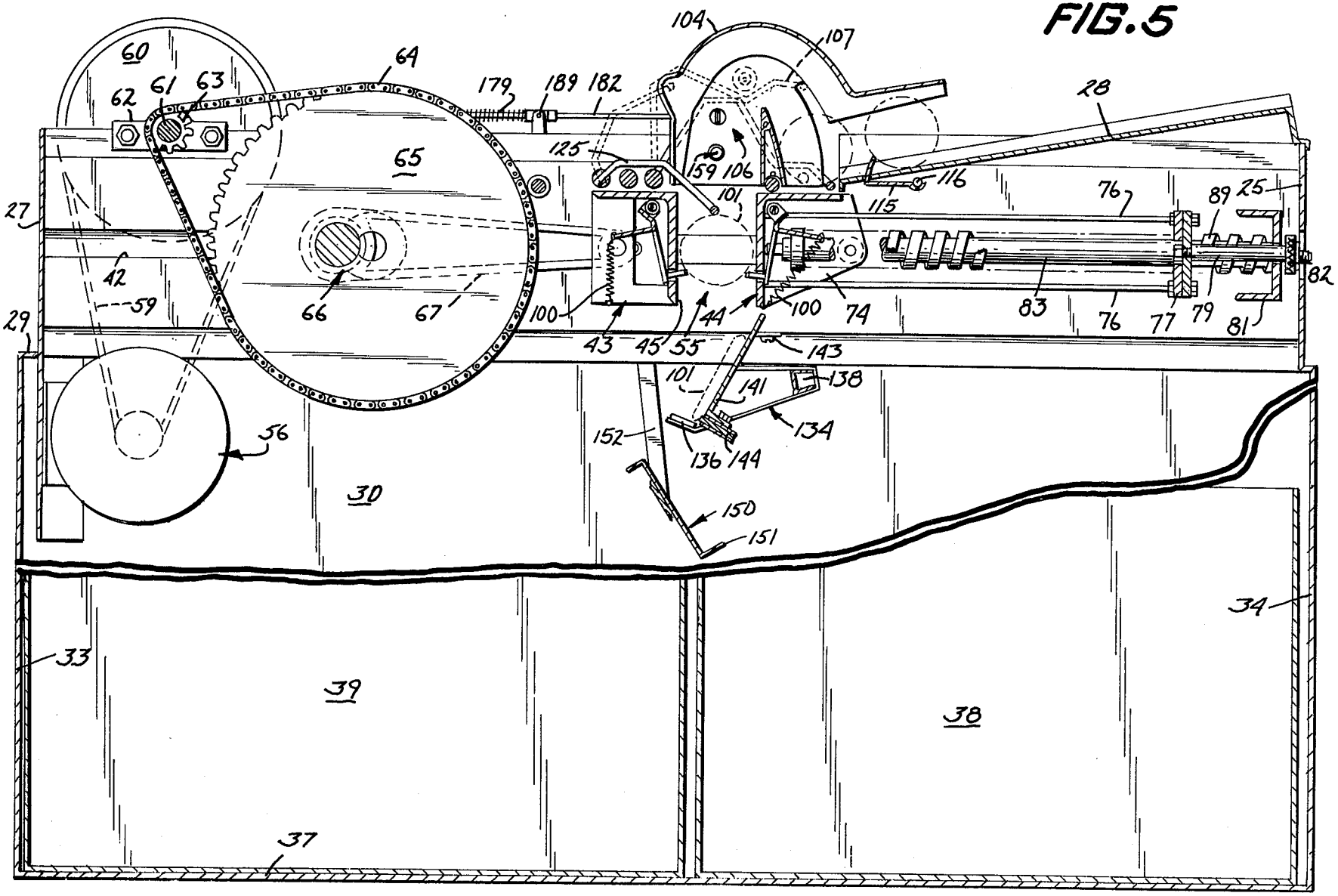
FIG. 5 is an enlarged fragmentary view in longitudinal section taken generally on the line 5—5 of FIG. 1.
Figure 10:
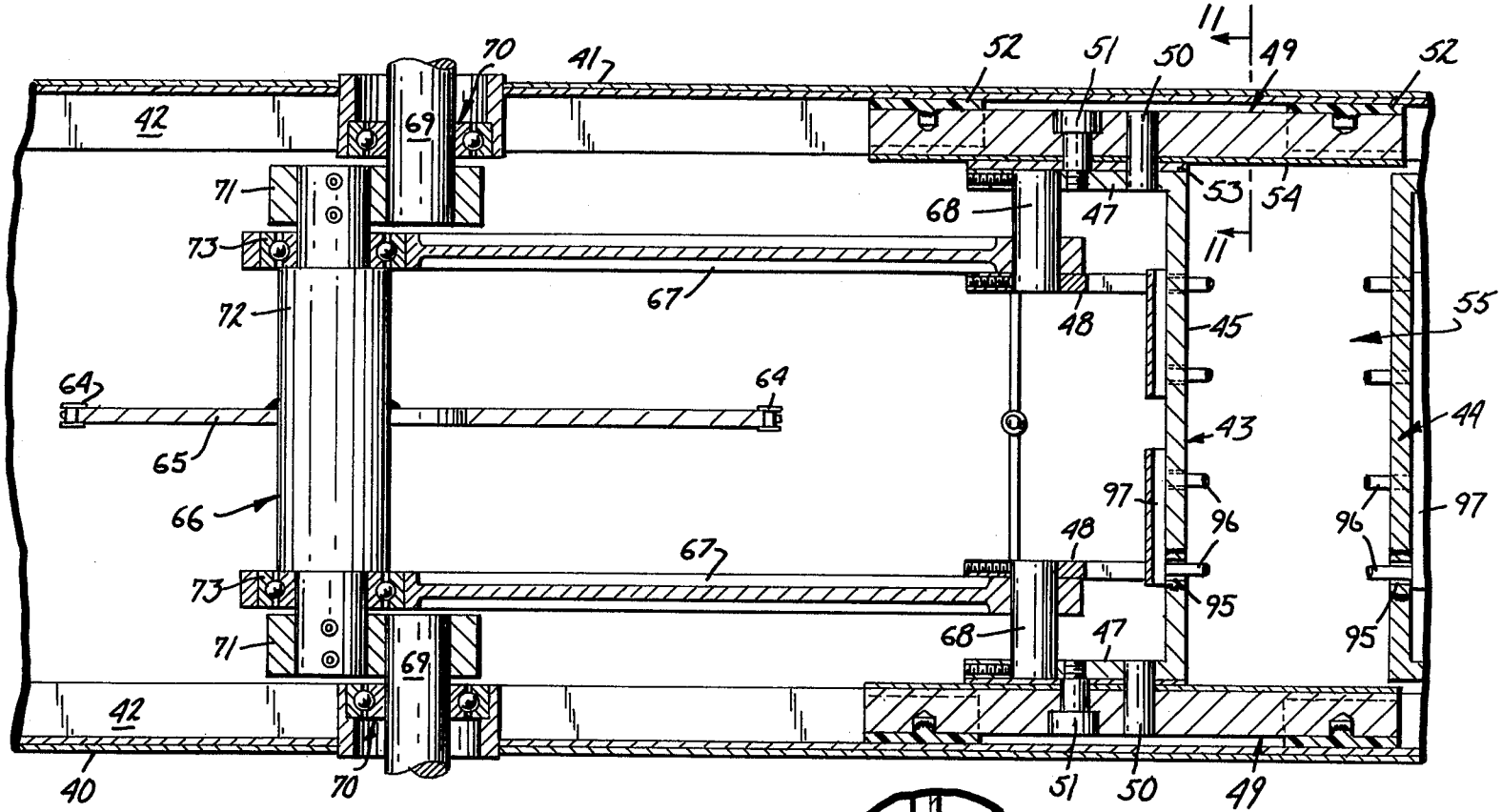
FIG. 10 is an enlarged fragmentary horizontal section taken generally on the line 10—10 of FIG. 4.
Figure 11:
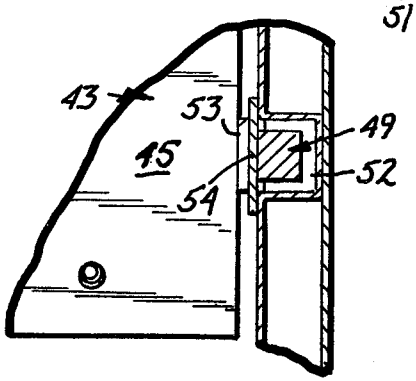
FIG. 11 is a fragmentary detail in section taken substantially on the line 11—11 of FIG. 10 and rotated ninety degrees.

The ram 43 and platen 44 are each formed to provide a plurality of laterally spaced openings 95 therethrough through which project support fingers 96 into the crushing zone 55, see particularly FIGS. 5 and 10. The support fingers 96 are secured to the lower edge portions of a pair of support plates 97 that are rigidly secured at their upper edge portions to respective ones of the ram and platen, as indicated at 98. The support plates 97 are provided with angularly displaced tongues 99 to which are connected the upper ends of coiled tension springs 100, these being connected at their lower ends to their respective ram and platen, to yieldingly urge the support plates 97 and fingers 96 toward container supporting positions shown in FIGS. 5, 10, and 12. Containers in the nature of beverage cans, are shown in FIG. 4, and by dotted lines in FIG. 5, and indicated at 101. When the ram 43 is moved into its most forwardly projected position responsive to rotation of the crank assembly 66, and a container 101 crushed or flattened therebetween, opposite sides of the flattened or crushed container 101 will move the fingers 96 against bias of their respective springs 100, so that when the ram 43 is subsequently moved away from the platen 44, the crushed container is permitted to drop downwardly from the crushing zone 55.

Means for guiding containers 101 from the ramp 28 toward the crushing zone 55 includes a pair of sidewall elements 102 that are supported from the side frame members 40 and 41 by suitable means including a pair of spacer elements 103, an outer guide member 104, and an inner guide member 105 supported from the side wall elements 102. The side wall elements 102 and guide members 104 and 105 cooperate with the top wall 46 of the ram 43 to define a testing zone 106 overlaying the crushing zone 55.

Figure 6:
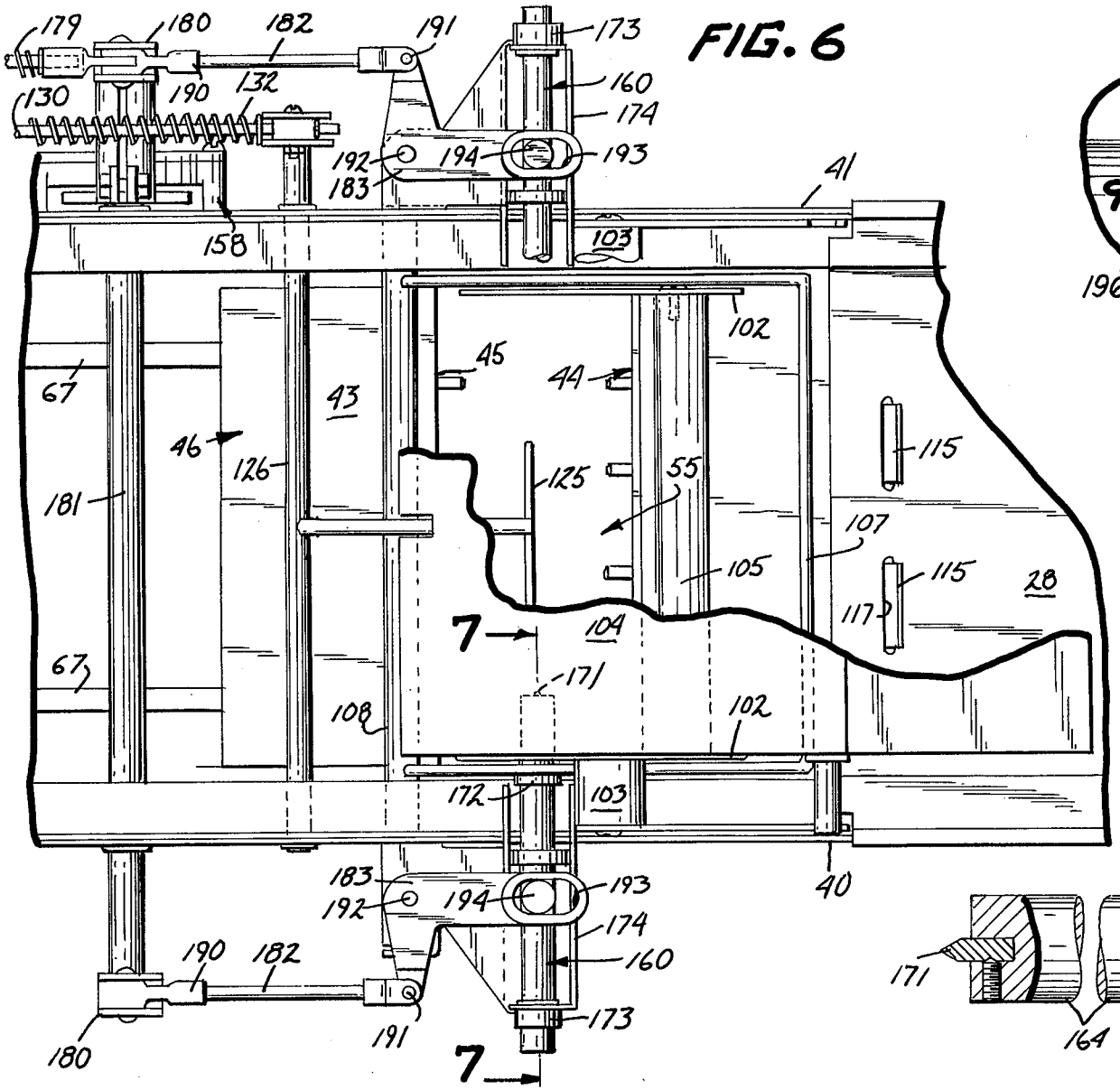
FIG. 6 is an enlarged fragmentary view in plan, as seen from the line 6—6 of FIG. 4, some parts being broken away.

A container feeding or lifting arm is mounted for swinging movements between a lower container receiving position and an upper container delivery position on a transverse shaft 108 that is journaled in the side frame members 40 and 41, see particularly FIGS. 5 and 6. Means for imparting swinging movements to the lifting arm 107 includes a cam 109 that is rigidly mounted on one of the crank shaft sections 69, a cam follower lever 110 pivotally connected at one end to the side frame member 40, a push rod 111 pivotally connected at one end to the cam follower lever 110, and a crank arm 112 pivotally secured at one end to the shaft 108 and having its opposite end portion slidably engaging the push rod 111. A coil compression spring 113 is mounted on the push rod 111, and is interposed between the opposite end of the crank arm 112 and an adjustment nut screw threaded on the push rod 111, to exert a yielding bias against the crank arm 112 in a container feeding direction responsive to rotation of the crank shaft sections 69. By adjusting the adjustment nut 114 on the push rod 111, the lifting force of the lifting arm 107 may be closely controlled, so that any container 101 weighing a predetermined maximum weight will not be delivered to the testing zone 106. A gate element 115 is mounted on a transverse shaft 116 journaled in the side frame members 40 and 41 below the ramp 28, for movements through an opening 117 in the ramp 28 between container intercepting and release positions respectively above and below the ramp 28, whereby to release containers 101 for engagement with the lifting arm, one at a time. A gate operating cam 118 is mounted on the crank shaft section 69 adjacent to the side frame element 40 and engages a cam follower roller 119 at one end of a lever 120 that is pivotally secured to the side frame member 40, as indicated at 121. The opposite end of the lever 120 is pivotally connected to one end of a link 122 the opposite end of which is pivotally connected to a crank arm 123 rigidly mounted on the shaft 116. A spring 124 yieldingly urges the cam follower roller 19 into engagement with the cam 118 and the gate element 115 upwardly into its container intercepting position shown in FIG. 5. The gate operating cam 118 is so shaped and positioned on the shaft section 69 that the gate element 115 will hold containers 101 on ramp 28 whenever the lifting arm 107 is raised from its lowered container receiving position.

Figure 2:
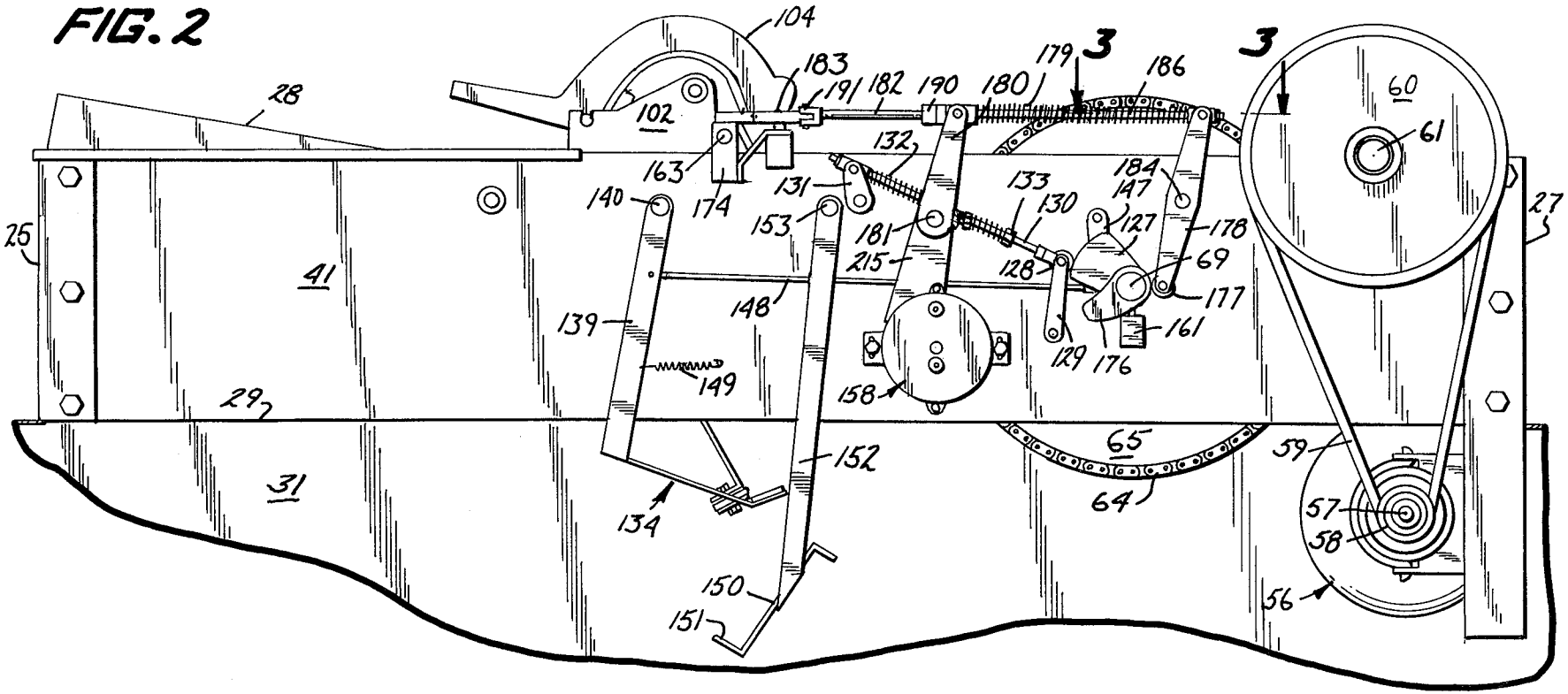
FIG. 2 is an enlarged fragmentary view in side elevation, as seen from said one side of FIG. 1, some parts being removed.
Figure 3:
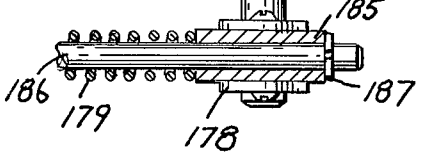
FIG. 3 is an enlarged fragmentary section taken on the line 3—3 of FIG. 2.
Figure 21:
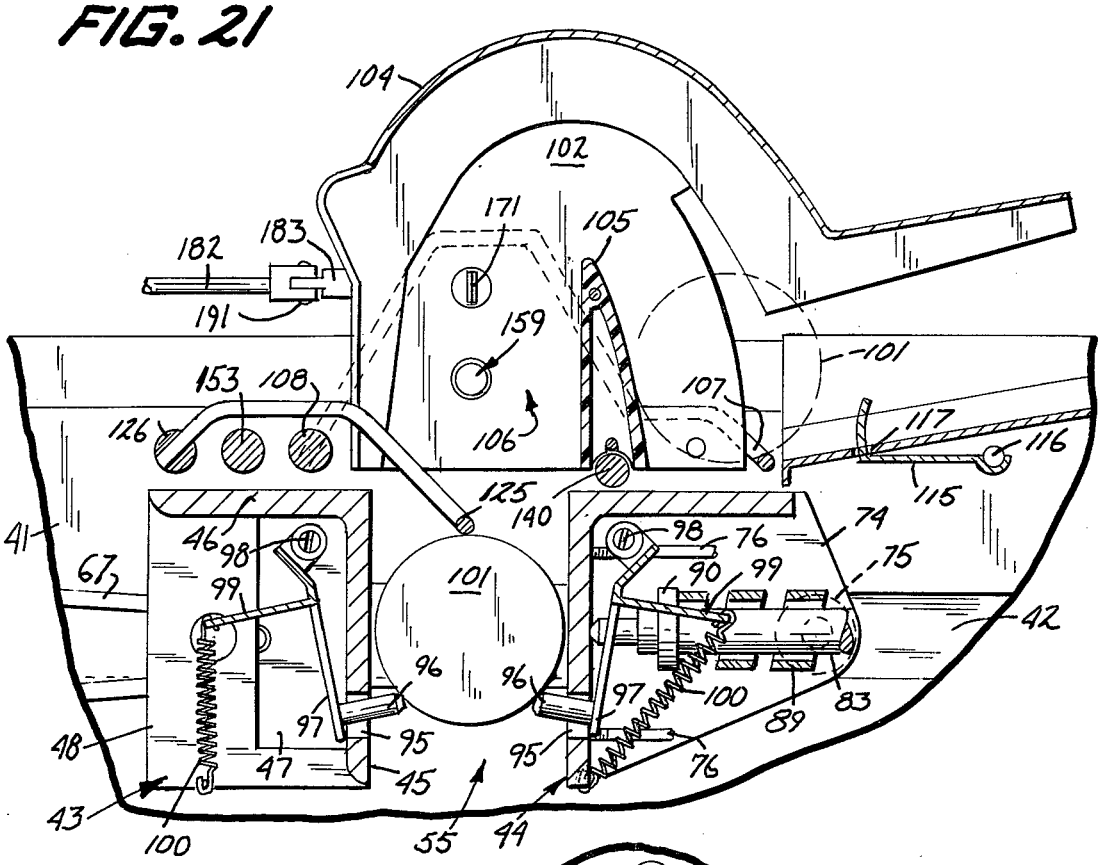
FIG. 21 is a fragmentary section corresponding to a portion of FIG. 5, on an enlarged scale.

The container lifting arm cam 109 is so shaped and disposed on its crank shaft section 69, that it moves the lifting arm 107 to deliver container 101 to the testing zone 106 when the ram 43 is in its advanced position toward the platen 44, so that the wall 46 of the ram 43 underlies the testing zone 106, for a purpose which will hereinafter become apparent. As soon as the ram 43 moves rearwardly away from the platen 44, a container 101 normally drops from the testing zone 106 to the crushing zone 55. In order to insure that the container will drop into the testing zone 55, an injector element 125 is provided. The injector element 125 is mounted at one end on a shaft 126 journaled in the side frame members 40 and 41 for movements between an inoperative position out of the path of travel of containers 101, as shown by dotted lines in FIG. 5, and a cam injecting position shown by full lines in FIGS. 5 and 21. Swinging movements are imparted to the injector element 125 at predetermined time intervals by an injector cam 127 rigidly mounted on one of the crank shaft sections 69, a cam follower roller 128 mounted on a crank arm 129 pivotally mounted on the side frame member 41, a push rod 130 pivotally connected at one end to the crank arm 129 and having its opposite end longinably slidably mounted on a second crank arm 131 fixed on the shaft 126, see particularly FIG. 2. A coil compression spring 132 is interposed between the sliding connection of the push rod 130 with the crank arm 131 and an adjustment nut 133 screw threaded on the push rod 130, to provide for an adjustable yielding lost motion connection between the crank arms 129 and 131.

Figure 19:
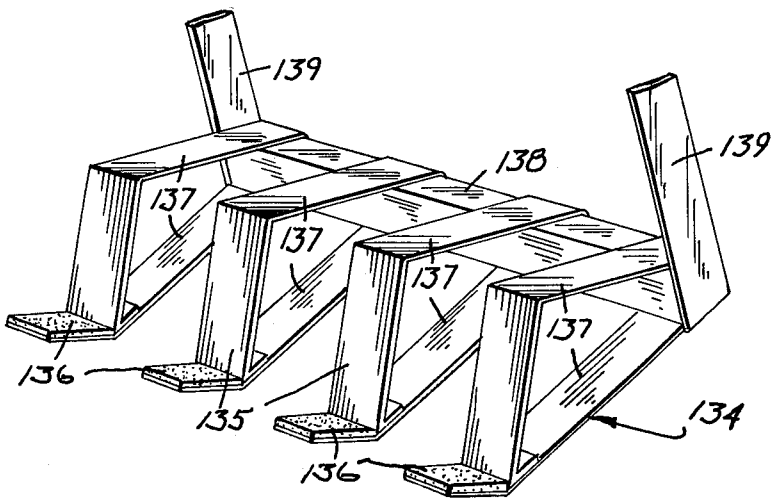
Figure 13:
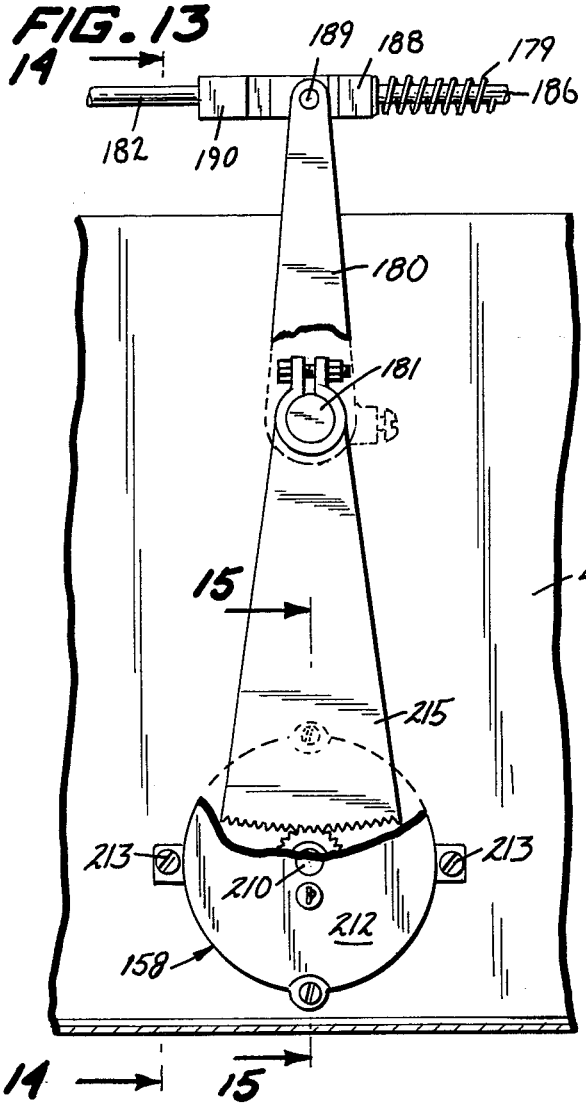
FIG. 13 is a further enlarged fragmentary view in side elevation corresponding to a portion of FIG. 2, some parts being broken away.
Figure 14:
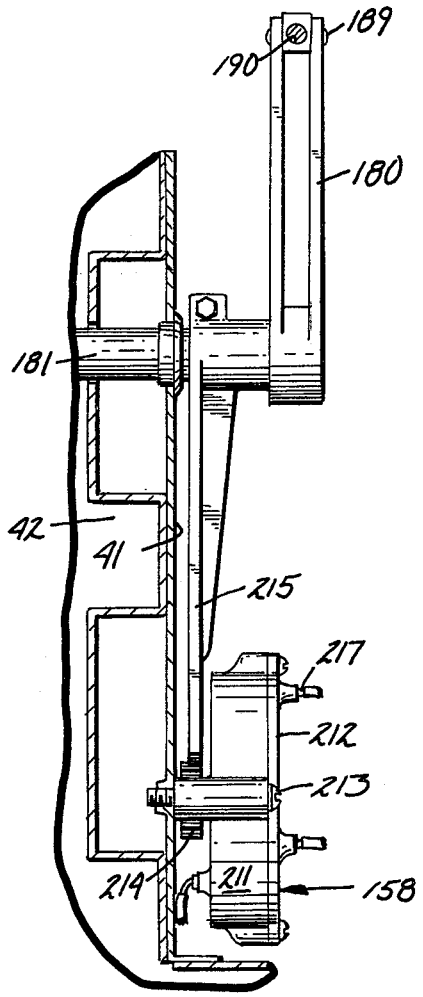
FIG. 14 is a fragmentary view partly in section and partly in elevation, taken generally on the line 14—14 of FIG. 13.
Figure 16:
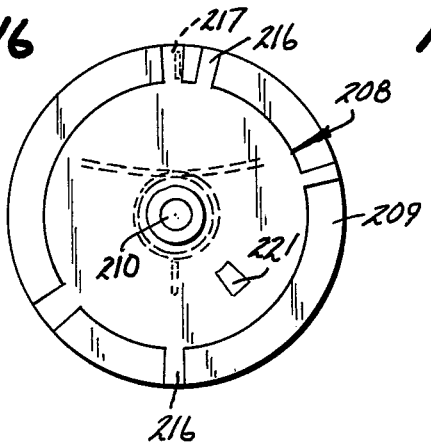
FIG. 16 is a fragmentary view in elevation as seen from the line 16—16 of FIG. 15, some parts being removed.
Figure 15:
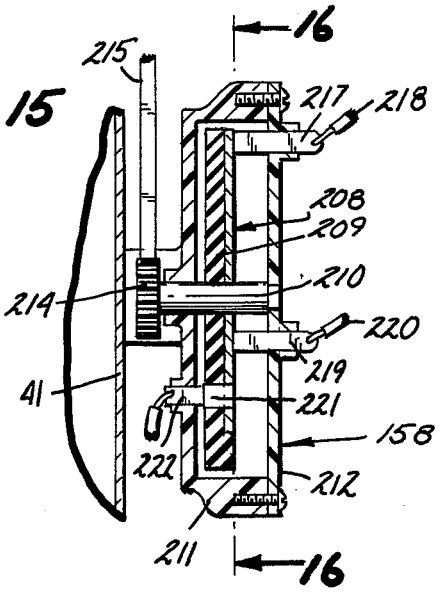
FIG. 15 is an enlarged fragmentary section taken on the line 15—15 of FIG. 13.

A catch member 134 includes a plurality of laterally spaced legs 135 which normally underlie the crushing zone 55, and which are provided with rearwardly projecting cushion equipped feet 136, the legs having portions 137 that are connected to a cross bar 138, see particularly FIG. 19. The catch member 134 is supported for swinging movements generally forwardly and rearwardly of the machine by a pair of laterally spaced arms 139 that are connected at their lower ends to the opposite ends of the cross bar 138 and at their upper ends to a transverse shaft 140 that is suitably journaled in the side frame members 40 and 41. The legs 135 and their feet 136 are adapted to pass between and on opposite sides of depending portions 141 of a mounting plate 142 that is formed to provide mounting flanges 143 that are secured to the lower edge portions of the side frame members 40 and 41 by suitable means, such as machine screws, one being shown in FIG. 5. At their lower ends, the depending portions 141 are provided with plate like magnets 144.

As shown in FIG. 5, the catch member 134 and mounting plate 142 are adapted to engage a crushed container 101 as it falls from the crushing zone 55, with the crushed container 101 resting upon the cushioned feet 136. During movement of the catch member 134 forwardly with respect to FIG. 5, the feet 136 will be withdrawn from the lower edge of the container 101, permitting the container to move downwardly with respect to the depending portions 141 of the mounting plate 142. In the event that the crushed container 101 is of magnetically responsive material, such as steel, the magnets 144 will hold the container from descending further when the feet 136 are withdrawn from beneath the crushed container.

A cam 145 is mounted fast on one of the crank shaft sections 69 adjacent the side frame member 41, and engages a cam follower roller 146 that is mounted on one end of a crank arm 147, the opposite end of the crank arm 147 being pivotally mounted on the adjacent side frame member 41. A connecting rod 148 is pivotally connected at one end to the end of the crank arm 147 adjacent the cam follower roller 146, and has its opposite end pivotally connected to one of the arms 139. A coil tension spring 149 is secured at one end to the side frame member 41, and at its opposite end to the adjacent depending arm 139, to urge the arms 139 and catch member 134 in one direction of swinging movement thereof, swinging movement in the opposite direction being imparted to the arms 139 and catch member 134 by the cam 145.

Figure 22:
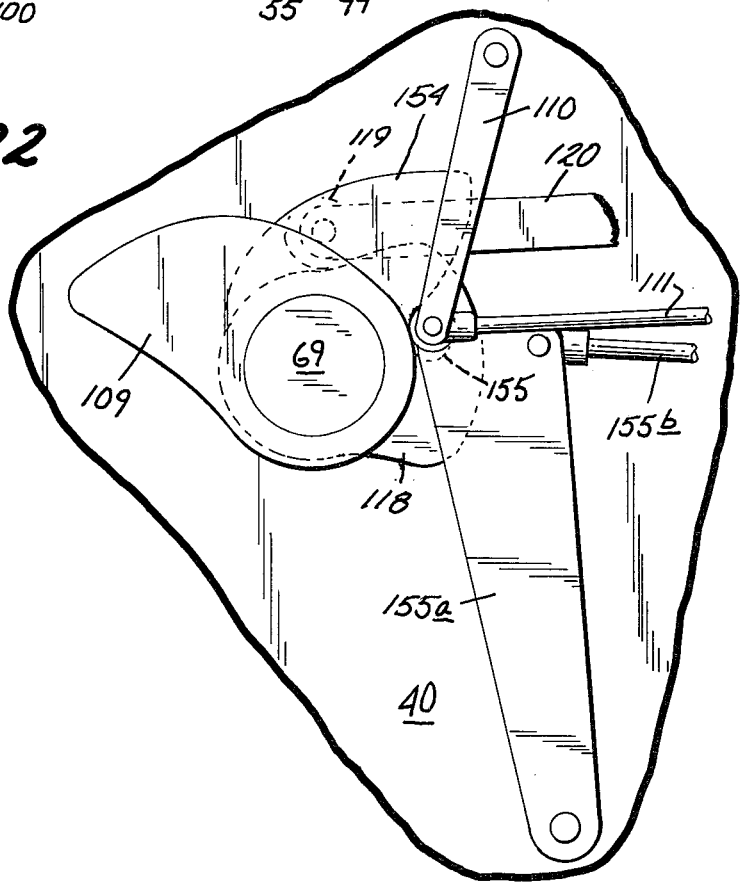
FIG. 22 is an enlarged fragmentary view in side elevation corresponding to a portion of FIG. 4.

A second catch member 150 at least partially underlies the catch member 134 and is formed at its bottom edge portion to provide a generally forwardly projecting flange 151 that is adapted to catch a crushed container 101 of nonmagnetically responsive material, such as aluminum or plastics. The catch member 150 is supported by a pair of laterally spaced arms 152 that depend from opposite ends of a transverse shaft 153 journaled in the side frame members 40 and 41, to enable the second catch member 150 to swing forwardly and rearwardly with respect to the machine. A cam 154, journaled on the crank shaft section 69 adjacent the side frame member 40, engages a cam follower roller 155 that is mounted on the upper end of an arm **155*a* that is pivotally secured at its lower end to the side frame member 40. A connecting rod 155*b* is pivotally secured at one end to the upper end portion of the arm 155*a* and at its opposite end to one of the depending arms 152, see particularly FIGS. 4 and 22. A coil tension spring 155*c* is secured at one end to the side frame member 40 and at its opposite end to the adjacent arm 152 to yielding urge the second catch member 150 in one direction of its swinging movement and to urge the cam follower roller 155 into engagement with its respective cam 154**.

Figure 20:
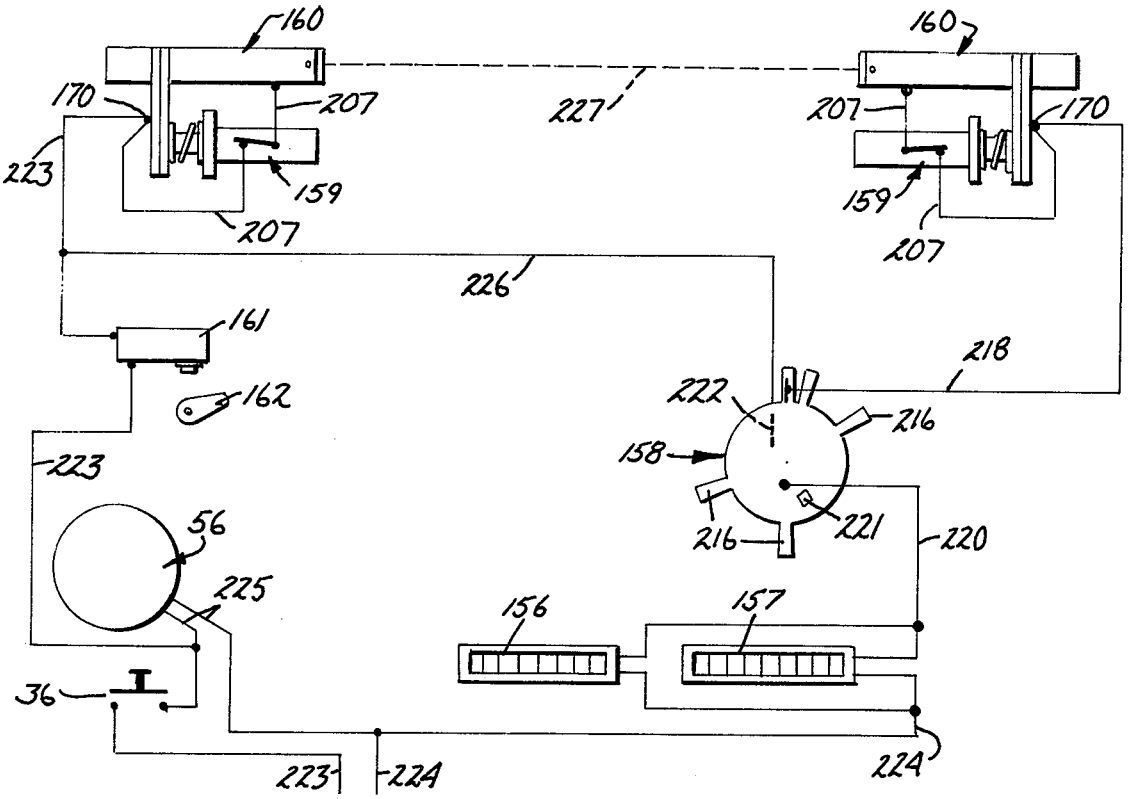
FIG. 20 is a wiring diagram.

The container crushing apparatus of this invention is particularly adapted to control power operated means such as commercially available counting or tallying devices, a pair of these devices being shown diagrammatically in FIGS. 1 and 20, and indicated at 156 and 157. Such counters are known and readily available on the market, and in and of themselves do not comprise the present invention. Hence, for the sake of brevity, detailed showing and description thereof is omitted. For the purpose of the present example, the counters 156 and 157 are shown as being mounted on one of the wall portions 25, in FIG. 1. The counters 156 and 157 are shown in FIG. 20 as being contained in control circuitry including the switch 36, the drive motor 56, a selector switch 158, a pair of normally closed magnetically operated switches 159, container engaging means in the nature of a pair of axially aligned probe members 160, and a normally open actuator switch 161 that is adapted to be momentarily closed by a cam 162 mounted fast on one of the crank shaft sections 69.

The probe members 160 are identical in structure, each comprising a generally cylindrical transversely outer and inner metallic sections 163 and 164 respectively and joined together by an insulator block or plate 165. Each insulator plate 165 is formed to provide a socket 166 for snug reception of a reduced end portion 167 of its respective outer section 163, each reduced portion 167 being anchored in its respective socket 166 by suitable means, such as an anchoring screw 168. Each inner probe member 164 has an axial opening in one end for reception of the socket 166 of its respective insulator plate 165, and is anchored thereto by suitable means such as a set screw or the like 169, see particularly FIG. 8. An electrical terminal in the nature of a machine screw 170 is screw threaded into each insulator plate 165. A pair of container engaging blade elements 171 are each removably mounted in the inner end of a different one of the probe member sections 164 for engagement with opposite ends of a container 101 at the marginal edges thereof, see FIG. 7. The blades 171 are sufficiently sharp to penetrate any protective coating on a metal container so as to make effective electrical contact with the container. Each probe member 160 is mounted for axial movement transversely of the testing zone 106 in axially spaced bearings 172 and 173 the former of which are mounted in the side wall elements 102 and the latter of which are mounted in brackets 174 welded to the side frame members 40 and 41. Each probe member section 164 has soldered thereto one end of one of a pair of electrical conductors 175. The bearings 172 and 173 are preferably made from synthetic plastic material, insulating the probe members sections 164 from the metal portions of the apparatus.

Means for imparting axial movements to the probe members 160 simultaneously toward and away from each other, for engagement of the blade elements 171 with opposite ends of a container, comprises a cam 176 rigidly mounted on one of the crank shaft sections 69, a cam follower roller 177 journaled on one end of a lever 178, a coiled compression spring 179, a pair of crank arms 180 rigidly mounted on a transverse shaft 181 journaled in the side frame members 40 and 41, a pair of push rods 182, and a pair of bell crank levers 183. The lever 178 is pivotally mounted on the side frame member 41 by means of a pivot shaft 184, and is bifurcated at its upper end to pivotally receive a tubular member 185 which axially slidably receives a support rod 186 which supports the coil compression spring 179. A split washer 187 is mounted on the rear end portion of the support rod 186, and engages the tubular member 185 to limit movement of the support rod 186 in one direction relative to the tubular member 185 and lever 178. The front end of the support rod 186 is mounted in a socket 188 pivotally mounted in the upper end of an adjacent one of the crank arms 180, as indicated at 189. The front end of the spring 179 abuts the socket 188, and yieldingly urges the lever 178 in the direction to maintain contact between the cam follower roller 177 and its respective cam 176, in addition to providing for a lost motion connection between the lever 178 and crank arms 180. A pair of socket members 190 are pivotally mounted to the upper end of the crank arms 180 by the pivotal connections 189, and have secured thereto the rear ends of the push rods 182, the front ends of the push rods being pivotally secured to respective bell cranks 183, as indicated at 191. The bell cranks 183 are pivotally mounted intermediate their ends on respective ones of the brackets 174 by pivot pins 192, see particularly FIG. 6. The opposite ends of the bell crank levers 183 are provided with slots 193 that receive studs or bosses 194 that project radially upwardly from the probe member sections 183, see particularly FIGS. 6 and 7. The connection of the crank arms 180 to the transverse shaft 181 provides for simultaneous movement of the probe members 160 responsive to rotation of the crank assembly 66 and the respective cam 176.

Figure 9:
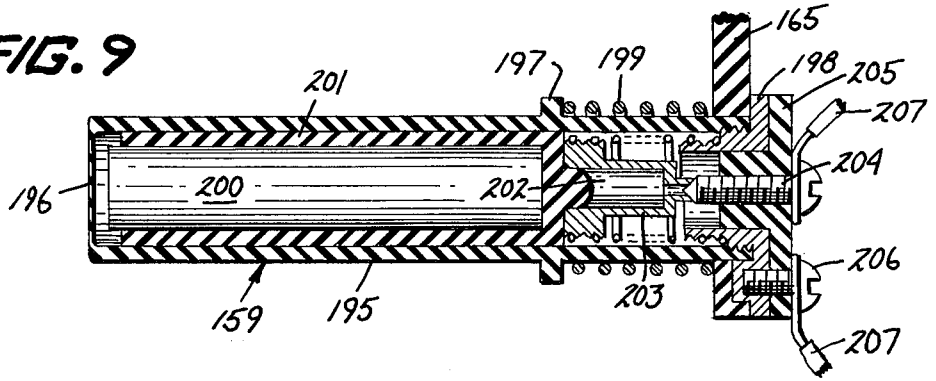
FIG. 9 is an enlarged fragmentary section taken on the line 9—9 of FIG. 7.
Figure 7:
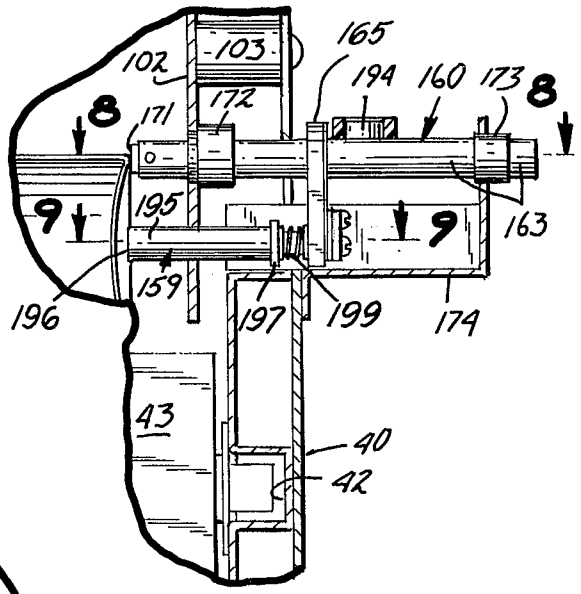
FIG. 7 is a fragmentary section taken generally on the line 7—7 of FIG. 6 and rotated ninety degrees with respect thereto.
Figure 8:
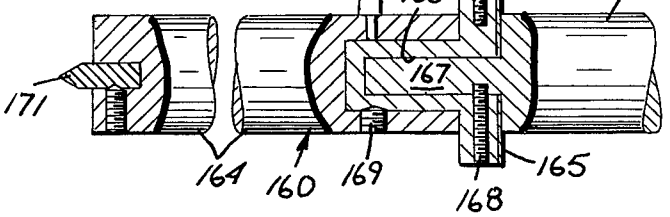
FIG. 8 is an enlarged axial section taken on the line 8—8 of FIG. 7.

The magnetically operated switches 159 are each enclosed in a different one of the pair of tubular housings 195, each of which is slidably mounted in a different one of the insulator plates 165 in laterally spaced parallel relationship to a respective probe member 160. The housings 195 have closed inner ends 196 and radially outwardly projecting circumferential flanges 197 intermediate their ends. The outer end portions of the housings 195 are screw-threaded to receive tubular flanged end members 198 that engage one side of their respective insulator plates 165 to limit axial sliding movements of the housings 195 in one direction. Coil compression springs 199 encircle the housings 195 between the flanges 197 and insulator plates 165 to yieldingly urge the housings 195 toward each other, the inner ends 196 being disposed in planes close to the the edges of the blade elements 171 as shown in FIG. 7. A pair of cylindrical magnets 200 are each mounted in a respective one of a pair of cylindrical mounting elements 201 that are each mounted in a different one of the housings 195 for axial sliding movements therein, one end of each of the magnets being disposed in closely spaced relationship to the inner end 196 of its respective housing 195. One of the magnets 200 is shown in FIG. 9. At their outer ends, the mounting elements 201 are formed to provide diametrically reduced stems 202 that are snugly received in respective ones of a pair of tubular contact elements 203. The contact elements 203 axially engage the inner ends of terminals in the nature of machine screws 204 that are screw-threaded in flanged plugs 205 each secured to a respective end 198 by a screw 206. Means yieldingly urging each contact element 203 into engagement with its respective terminal screw 204 comprises a coil tension spring screw-threaded at one end to the threaded portion of its respective contact element 203 and at its other end to its respective flanged end member 198. Thus, each contact element 203 and its respective terminal screw 204 constitutes one of the normally closed switches 159. It will be noted that each housing 195 and its respective mounting element 201 is made from electrical insulating material, such as commercially available synthetic plastics, the flanged end members being made from suitable electrically conductive metal. When the probe members 160 are moved into engagement with a container in the testing zone 106, the housings 195 are moved therewith, so that the inner ends 196 of the housings 195, together with the inner ends of their respective magnets 200 will be disposed in sufficiently close relationship to the adjacent ends of the container whereby, if the container is made of magnetically responsive material, such as steel, movement of the magnets 200 toward the container will open their respective switches 159. With reference to FIG. 9, it will be noted that the lead 175, extending from the probe member section 164 at an adjacent probe member 160, is connected to the adjacent screw 206, and that a flexible lead 207 extends from the terminal screw 104 to the terminal screw 204 to the terminal screw 170 of its adjacent probe member 160. When the probe members are moved into engagement with opposite ends of a container 101, the coil compression springs 199 permit relative movement between each housing 195 and its respective probe member 160 should the end 196 of the housings 195 engage the containers prior to engagement thereof by the probe members 160.

The selector switch 158 is arranged to provide electrical circuitry to the counters 156 and 157 when containers of different axially lengths are fed into the machine. The selector switch 158 comprises a rotary disc contact 208 secured to a mounting plate 209 that is mounted on a rotary shaft 210 for common rotation therewith, the shaft being journaled in a housing 211 and a cover plate 212 therefor. The housing 211 is rigidly secured to the side frame member 41 by machine screws of the like 213 in radially spaced relation to the end portion of the transverse shaft 181, see particularly FIGS. 2 and 13–15. A toothed pinion 214 is mounted fast on the shaft 210, and has meshing engagement with a segmental gear rack 215 that is rigidly mounted on the shaft 181 for common pivotal movement therewith. The disc contact 208 is formed to provide a plurality of circumferentially spaced radially projecting portions that are adapted to make electrical contact with a terminal pin 217 that is mounted in the cover plate 212, and to which is connected one end of a lead 218 the other end of which is connected to the terminal screw 170 of one of the probe members 160. A second terminal pin 219 is mounted in the cover plate 212 for continuous sliding engagement with the disc 208, and has connected thereto a lead 220 that extends to the counters 156 and 157.

Since beverage and other cylindrical containers are provided in various axial lengths, and since it is desired to count or register the reception of containers of given sizes, the contact disc 208 is provided with a plurality of radially projecting portions 216 corresponding in number to the sizes of containers which it is desired to count. The contact disc 208 is rotated alternately in opposite directions with each inward and outward movement of the probe members 160 during a single rotation of the cam 176.

A connector element 221 extends inwardly from the contact disc 208 through the mounting plate 209 to the rear surface thereof, and is adapted to make electrical contact with a terminal pin 222 mounted in the housing 211, when the blades 171 of the probe members 160 engage opposite ends of a container of a material which is non-conducting, such as a plastic container of a length differing from those of metallic containers.

In the diagram of FIG. 20, a pair of leads 223 and 224 may be assumed to be connected to a source of electrical potential, the lead 223 extending through the manually operated switch 36 and actuator switch 161 to the terminal 170 of the probe member 160 opposite that to which the lead 218 is connected. The motor 56 is connected to the leads 223 and 224 by connecting leads 225, and is energized by closing of the foot operated switch 36. A shunt lead 226 is connected at one end to the terminal pin 222, and at its other end to the lead 223 between the switch 161 and its adjacent or respective terminal screw 170 whereby to shunt out the portion of the circuit that includes the probe members 160 and their respective magnetically switches 159. In FIG. 20, current flow through a container engaged by the probe members 160 is indicated by a dotted line 227.

OPERATION

The operator places one or more containers on the ramp 28 and inserts his foot into the opening 35 to close the switch 36. The switch 36 will remain closed as long as the operator engages the same. This closing of the switch 36 energizes the motor 56 which rotates to impart reciprocatory movement to the ram 43 toward and away from the platen 44, as well as rotation to the several cams 109, 118, 127, 145, 154, 152, and 176. The several cams are so shaped, and circumferentially so spaced relative to each other and to the crank assembly 66, that the several elements of the apparatus operates as follows:

Initially, the cam 118 imparts movement to the gate element 115 to permit a container 101 to roll downwardly on the ramp 28 into overlying engagement with the lifting arm 107. As soon as a single container 101 has rolled past the gate 115, the gate will rise to hold subsequent containers 101 against movement into the machine. The cam 109 will then impart lifting movement to the lifting arm 107 while the cam 127 will move the injector element 125 upwardly to its dotted line position of FIG. 5 to permit the lifted container to fall into the testing zone 106 to rest upon the top wall 46 of the ram 43, the ram 43 having been moved to its limit of forward movement adjacent the platen 44. As soon as the container 101 is disposed in the testing zone 106, the cam 176 imparts movement to the probe members 160 so that the blades 171 thereof contact the opposite ends of the container 101. Simultaneously, the contact disc 208 is rotated to a given extent permitted by engagement of the container by the probe members 160. If, when such engagement is made, one of the radially projecting portions 216 engages the terminal pin 217, a potential circuit is established to the counters 156 and 157. However, should the container 101 be of steel or other magnetically responsive material, one or both of the switches 159 will be opened by their respective magnets 200 so that there will be no current flow through the selector switch 158. Immediately after contact has been made between the probe members and the container, the cam 162 will rotate to close the switch 161 completing the circuit through the probe members, container and selector switch to energize the counters 156 and 157. In the arrangement illustrated, if the container 101 is a steel container, the switches 159 will be opened and the counters 156 and 157 will not register that particular container. In the event that the container 101 is a nonconducting container such as a plastic can of a predetermined axial length, the probe members 160 will permit rotation of the contact disc 208 to a point where the connector element 221 will engage the terminal pin 222 and establish the potential circuit through the counters 156 and 157 by means of the shunt lead 226, so that when the switch 161 is subsequently closed, the counters 156 and 157 will be energized to register or count the plastic container. Immediately upon reopening of the switch 161, the probe members 160 are moved away from engagement with the container 101, the ram 43 is moved to its rearmost position, and the cam 127 swings the injector element 125 downwardly to engage the container 101 and insure its dropping into the crushing zone 55, after which the cam 127 immediately moves the injector element 125 to its uper position shown by dotted lines in FIG. 5. The ram 43 is then advanced by rotation of the crank assembly 66 to crush the container 101 therebetween and the platen 44 and, upon withdrawal of the ram 43, crushed container 101 will fall to rest upon the feet 136, legs 135, and depending portions 141. At this time, the cam 154 will rotate to swing the catch member 134 rearwardly to disengage the feet 136 from the crushed container 101. In the event that the crushed container 101 is nonmagnetically responsive, it will drop into engagement with the second catch member 150. In the event that the crushed container 101 is magnetically responsive, the magnets 144 will prevent the same from dropping to the second catch member 150, and continued rotation of the cam 145 will move the legs 135 rearwardly beyond the depending portions 141 to break the crushed container 101 away from the magnets 144 and impel the crushed container rearwardly into the receptacle 39. At substantially the same time, the cam 154 operate to swing the second catch member 150 forwardly so that, if the crushed container 101 is nonmagnetically responsive, the resting on the catch member 150, the forward movement thereof will impel the crushed container forwardly into the receptacle 38. Thus, the magnetically responsive and nonmagnetically responsive containers are automatically separated after the same are crushed.

It will be appreciated that, with each revolution of the crank assembly, a container will be tested in the testing zone 106 while another container is being crushed in the crushing zone 55, the operation being repeated as long as containers are supplied to the ramp 28 and the foot operated switch 36 is held closed.

MODIFICATION OF FIGURES 24–27

A modified magnetically operated switch arrangement is illustrated in FIGS. 24–27 to detect containers having magnetically responsive cylindrical walls. This form of magnetically operated switch comprises a permanent magnet 228 that is mounted on the lower end of a metallic hanger 229 having a bifurcated upper end 230 that is journaled on a shaft 231, and held thereon by screws 232. The shaft 231 is rigidly mounted in a bracket 233 that is supported from the opposite side frame members 40 and 41, one of which is shown, by upwardly projecting support bars 234, one of which is shown, supported or otherwise rigidly secured to the frame members 40 and 41 by nut equipped screws or the like 235, and a support rod **234*a* that is secured at its opposite ends to the upper end of the bars 234. A nonmagnetically responsive, preferably nonmetallic, guide member 236 extends downwardly from the shaft 231 and has an opening 237 in its lower end portion for free reception of the end of the magnet 228 opposite that which is secured to the hanger 229. The magnet 228, hanger 229 and bracket 233 project inwardly through an opening 238 in an outer guide member 104' similar to the outer guide 104. The guide member 236 is disposed to form a continuation of the guide member 104' within the testing zone, the magnet 228 being disposed adjacent a container 101 when the container is in the testing zone. The magnet 228 is yieldingly urged away from engagement with the container 101 by a coil compression spring 239 that is mounted on a post 240 projecting from the guide member 236 through an opening 241 in the hanger 229**.

A generally U-shaped metallic bar 242 is mounted at its opposite ends to the lower end portion of the guide member 236, by nut equipped screws or the like 243, and at its central portion is provided with a terminal screw 244 that normally engages a cooperating terminal plate 245 on the hanger 229. The terminals 244 and 245 provide a switch that is normally closed by the spring 239 and which is opened by movement of the magnet 228 toward a container 101 that may be magnetically responsive. A pair of leads 175' and 207' are connected to the shaft 231 and bar 242 respectively, these being identical to the leads 175 and 207 respectively, so that the switch comprising the terminals 244 and 245 may be substituted for one or both of the switches 159.

While I have shown and described a commercial embodiment of my improved apparatus for crushing containers, and a modified arrangement, it will be understood that the same is capable of further modification, and that such further modification may be made without departurefrom the spirit and the scope of the invention, as defined in the claims.

What is claimed is:

1. Container crushing apparatus comprising:

(a) a frame structure;

(b) crushing means carried by said frame structure and including a relatively stationary platen and a relatively movable ram cooperating with the platen to define therebetween a crushing zone;

(c) container feeding means for feeding containers singly and in succession to said crushing zone;

(d) power operated mechanism for imparting container crushing reciprocatory movements to the ram toward and away from said platen;

(e) a pair of spaced receptacles for crushed containers;

(f) container delivery means underlying the crushing zone and including a magnet for receiving crushed containers from the crushing zone and delivering each crushed container to a predetermined one of said receptacles;

(g) power operated means;

(h) and control means for said power operated means operative to energize said power operated means responsive to feeding of given ones of said containers toward the crushing zone and including:

(i) a pair of container engaging probe members;

(ii) means mounting said probe members in said frame structure for movements toward and away from engagement with opposite ends of a container;

(iii) linkage operatively connected to said power operated mechanism for imparting said movements to the probe members;

(iv) and a selector switch operated by said linkage and disposed in an electrical circuit including said probe members and a container when the container is engaged by said probe members.

2. The apparatus defined in claim 1, characterized by means defining a testing zone above said crushing zone, said container engaging means being disposed to engage a container in said testing zone, said container feeding means including an injector for moving a container from said testing zone to said crushing zone.

3. The apparatus defined in claim 2 in which ram includes a generally horizontal wall defining a bottom of said testing zone when the ram is at its limit of movement toward said platen, characterized by connections between said power operated mechanism and said injector for imparting container feeding movement to said injector responsive to movement of said ram away from said platen.

4. The apparatus defined in claim 3 in which said power operated mechanism includes a rotary crank shaft journaled in said frame structure, a pair of pitman arms journaled at one end on said crank shaft in spaced apart relationship axially of the crank shaft and connected at their opposite ends to said ram, said connections including an injector operating cam on said crank shaft.

5. The apparatus defined in claim 1 in which said power operated mechanism includes a rotary shaft journaled in said frame structure, said feeding means including a lifting member and motion transfer mechanism between said rotary shaft and said lifting member for imparting container lifting movements to the lifting member responsive to rotation of said shaft.

6. The apparatus defined in claim 5 in which said motion transfer mechanism includes yielding means and means for adjusting the yielding bias of said yielding means in accordance with weight of containers to be crushed.

7. The apparatus defined in claim 1 in which said selector switch comprises a pair of relatively stationary switch elements and a relatively movable switch element, one of said switch elements having a plurality of portions spaced apart at predetermined distances, said movable switch element being moved by said linkage to bring selected ones of said spaced apart portions into operative contact with one of said relatively stationary switch elements.

8. The apparatus defined in claim 7 in which said linkage includes a lost motion connection between said power operated mechanism and its said probe members, the extent of movement of said movable switch element being determined by the spacing between said probe members when moved into engagement with a container disposed therebetween.

9. The apparatus defined in claim 8 in which said relatively movable switch element comprises a rotary conductor having a plurality of contact portions spaced apart circumferentially of the direction of rotation of said rotary conductor, one of said relatively stationary switch elements having constant engagement with said rotary conductor and the other disposed to engage given ones of said contact portions responsive to rotation of said rotary conductor.

10. The apparatus defined in claim 1 in further combination with at least one magnetically operated switch for preventing energization of said power operated means responsive to engagement by said probe members with a magnetically responsive container.

11. The apparatus defined in claim 10 in which said selector switch has connections in said circuit to energize the power operated means independently of said probe members when said probe members are spaced apart a given predetermined distance.

12. The apparatus defined in claim 11 in which said control means includes a normally open actuator switch in said circuit operative responsive to operation of said power operated mechanism in moving said ram to a predetermined position of its movement to complete the circuit through said selector switch whereby to energize said power operated means.

13. Container crushing apparatus comprising:

(a) a frame structure;

(b) crushing means carried by said frame structure and including a relatively stationary platen and a relatively movable ram cooperating with the platen to define therebetween a crushing zone;

(c) container feeding means for feeding containers singly and in succession to said crushing zone;

(d) power operated mechanism for imparting container crushing reciprocatory movements to the ram toward and away from said platen;

(e) power operated means;

(f) and control means for said power operated means, including container engaging means, and operative to energize said power operated means responsive to feeding of given ones of said containers toward the crushing zone;

(g) said container engaging means comprising a pair of probe members, means mounting said probe members in said frame structure for movements toward and away from engagement with opposite ends of a container, and linkage operatively connected to said power operated mechanism for imparting said movements to the probe members, said control means further including a selector switch operated by said linkage and disposed in an electrical circuit including said probe members and a container when the container is engaged by said probe members.

14. The apparatus defined in claim 13, characterized by a pair of spaced receptacles for crushed containers, and container delivery means underlying the crushing zone and including a magnet for receiving crushed containers from the crushing zone and delivering each crushed container to a predetermined one of said receptacles, said container delivery means comprising a catch member movable toward and away from said delivery means magnet, and connections between said power operated mechanism and said catch member for imparting movements to said catch member in a direction to throw a magnetically responsive crushed container thereon toward a given one of said receptacles.

15. The apparatus defined in claim 14 in which said container delivery means comprises a second catch member normally generally underlying said first mentioned catch member and adapted to catch a magnetically nonresponsive container from said crushing zone, means mounting said second catch member for movements in a direction to toss a container thereon toward the other one of said receptacles, and means operatively connected to said power operated mechanism for imparting container tossing movements to said second catch member.

16. The apparatus defined in claim 13 in which said probe members include opposed blade elements having edges positioned to engage the ends of a container at the marginal edges of the container, said blade element edges being sufficiently sharp to penetrate protective coating material on the container whereby to insure electrical contact with the metal of a metal container.

* * * * *

UNITED STATES PATENT AND TRADEMARK OFFICE

CERTIFICATE OF CORRECTION

PATENT NO. : 4,091,725

DATED : May 30, 1978

INVENTOR(S) : Ewald A. Arp

It is certified that error appears in the above-identified patent and that said Letters Patent are hereby corrected as shown below:

Column 1, line 46, the word "therefore" should be --therefor--.

Column 5, line 34, after "arm" insert --107--.

Column 5, line 51, after "lifting" delete the word "arm".

Column 7, line 16, the word "yielding" should be --yieldingly--.

Column 9, line 54, the word "of" should be --or--.

Column 11, line 54, the word "operate" should be --operates--.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*